US010344448B2

(12) United States Patent
Azzolin et al.

(10) Patent No.: US 10,344,448 B2
(45) Date of Patent: Jul. 9, 2019

(54) CRUSHER BUCKET

(71) Applicant: MECCANICA BREGANZESE S.P.A in breve MB S.P.A., Fara Vicentino (VI) (IT)

(72) Inventors: Diego Azzolin, Breganze (IT); Guido Azzolin, Breganze (IT)

(73) Assignee: MECCANICA BREGANZESE S.P.A. IN BREVE MB S.P.A., Fara Vincentino (VI) (IT)

( * ) Notice: Subject to any disclaimer, the term of this patent is extended or adjusted under 35 U.S.C. 154(b) by 0 days.

(21) Appl. No.: 15/743,010

(22) PCT Filed: Jul. 11, 2016

(86) PCT No.: PCT/IB2016/054133
§ 371 (c)(1),
(2) Date: Jan. 9, 2018

(87) PCT Pub. No.: WO2017/006299
PCT Pub. Date: Jan. 12, 2017

(65) Prior Publication Data

US 2018/0216310 A1 Aug. 2, 2018

(30) Foreign Application Priority Data

Jul. 9, 2015 (IT) ..... 102015000032666

(51) Int. Cl.
*B02C 1/04* (2006.01)
*E02F 3/407* (2006.01)
(Continued)

(52) U.S. Cl.
CPC ..... *E02F 3/407* (2013.01); *B02C 1/04* (2013.01); *E02F 3/965* (2013.01); *E02F 7/06* (2013.01)

(58) Field of Classification Search
CPC .... B02C 1/02; B02C 1/06; B02C 1/04; B02C 1/10; B02C 1/047; B02C 1/025;
(Continued)

(56) References Cited

U.S. PATENT DOCUMENTS 2,485,718 A 10/1949 Ebersol
2,605,051 A * 7/1952 Bogie ..... B02C 1/025 241/205
(Continued)

FOREIGN PATENT DOCUMENTS

CN 2184481 Y 12/1994
EP 3073019 A1 9/2016
(Continued)

OTHER PUBLICATIONS

International Search Report in PCT/IB2016/054133 dated Oct. 11, 2016.
Written Opinion in PCT/IB2016/054133, dated Oct. 11, 2016.

*Primary Examiner* — Robert E Pezzuto
(74) *Attorney, Agent, or Firm* — Kristina Castellano; Castellano PLLC

(57) ABSTRACT

Provided is a crusher bucket including a casing in which there are mounted crushing elements including a fixed jaw and a movable jaw, in which the movable jaw is supported on the casing by a pair of eccentric shafts, and further including an adjustment device capable of varying a distance between the fixed jaw and the movable jaw at least in the region of a discharge of the material.

10 Claims, 18 Drawing Sheets

(51) Int. Cl.
*E02F 3/96* (2006.01)
*E02F 7/06* (2006.01)

(58) Field of Classification Search
CPC ..... B02C 21/02; B02C 23/02; B02C 23/08; E02F 3/407; E02F 3/965; E02F 3/437; E02F 3/404; E02F 7/06
USPC ..... 37/445, 444; 241/101.74, 101.75, 264, 241/267, 269, 69, 101.2, 101.73, 266
See application file for complete search history.

(56) References Cited

U.S. PATENT DOCUMENTS

| | | | | | |
|---|---|---|---|---|---|
| 3,001,729 | A * | 9/1961 | Conway | B02C 1/06 | 241/148 |
| 3,211,388 | A * | 10/1965 | Gartner | B02C 1/02 | 241/147 |
| 3,860,183 | A * | 1/1975 | Bogie | B02C 1/04 | 241/217 |
| 4,382,560 | A * | 5/1983 | Toole | B02C 1/06 | 241/101.2 |
| 4,756,483 | A * | 7/1988 | McConnell, Jr. | B02C 1/02 | 241/101.2 |
| 7,222,807 | B2 * | 5/2007 | Azzolin | B02C 1/025 | 241/101.73 |
| 2012/0018558 | A1 | 1/2012 | Gervais | | |

FOREIGN PATENT DOCUMENTS

| | | | |
|---|---|---|---|
| JP | H11 61876 | A | 3/1999 |
| WO | 2014/086429 | A1 | 6/2014 |

* cited by examiner

CRUSHER BUCKET

CROSS REFERENCE TO RELATED APPLICATIONS

This application is a U.S. National Stage Application of International Patent application PCT/IB2016/054133 filed on Jul. 11, 2016, which claims priority to Italian patent application 102015000032666 filed on Jul. 9, 2015, the contents of both of which are incorporated herein by reference.

FIELD

The present invention relates to an improved crusher bucket, in particular for crushing inert material, processing waste and demolition material, hereinafter generally referred to as crushed stone, according to the preamble of the main claim.

BACKGROUND OF THE INVENTION

In the technical field being referred to, there are known buckets which comprise an outer casing which is configured to collect crushed stone and inside which there are mounted crushing elements for the collected material.

It may be noted that, in this context, the term "bucket" is intended to be understood generally to indicate any member which is provided for being and intended to be engaged at the free end of an arm of an operating machine.

The crushing elements which are provided in the casing typically comprise a pair of jaws which face each other, one movable with respect to the other in order to compress and crush the material present therebetween.

On the basis of one of the known configurations, the bucket comprises a first jaw which is positioned on the base of the bucket and which is fixed with respect to the casing during the crushing operations and a second movable jaw which is fixed to a pair of rotatable eccentric shafts.

In this manner, the movable jaw carries out pivoting movements with respect to the fixed jaw, carrying out the crushing of the material which is interposed between the two casings.

In those known buckets, the eccentric shafts are connected to the casing by means of a support structure, which is fixed to an upper wall thereof and which faces a fixing plate which is intended for connecting the bucket to the arm of the operating machine.

However, those known buckets have the disadvantage of not being sufficiently resistant to the stresses which are produced by the material during the crushing operations. This may involve significant technical problems in the structure of the crusher bucket, and may not allow effective control of the crushing effect, both in accordance with the dimensions of the material to be crushed and in accordance with the dimensions which it is desirable to obtain at the end of the crushing.

BRIEF SUMMARY OF THE INVENTION

Therefore, the technical problem addressed by the present invention is to provide a crusher bucket which allows the disadvantages mentioned above to be overcome and which is structurally and functionally configured to overcome the disadvantages set out above with reference to the prior art cited.

That problem is solved by the crusher bucket according to claim 1.

Preferred features of the invention are defined in the dependent claims.

The present invention has some relevant advantages. The main advantage involves the fact that the bucket according to the present invention allows control of the crushing effect so as to both be able to adapt to the dimensions of the material to be crushed and to be able to control the dimensions of the crushed material.

According to another aspect, the invention also relates to a crusher bucket which comprises a casing, in which there is defined an inlet for the material to be crushed and a discharge for the crushed material, a fixed jaw and a movable jaw, which is connected to the casing by means of at least one eccentric shaft, and a protection plate which is connected to the movable jaw in the region of a support element and which is directed towards the inlet opening, in which the protection plate is connected to the support element by means of an attenuation element so as to allow limited movements for the protection plate with respect to the support portion.

On the basis of that aspect of the invention, it is possible to accompany the material in an optimum manner towards the crushing zone which is interposed between the two jaws, thereby contributing to optimization of the crushing of the material.

BRIEF DESCRIPTION OF THE SEVERAL VIEWS OF THE DRAWINGS

Other advantages, features and the methods of use of the present invention will become evident from the following detailed description of some embodiments, which are set out by way of non-limiting example. Reference will be made to the Figures of the drawings, in which.

DETAILED DESCRIPTION

Figure 1B:
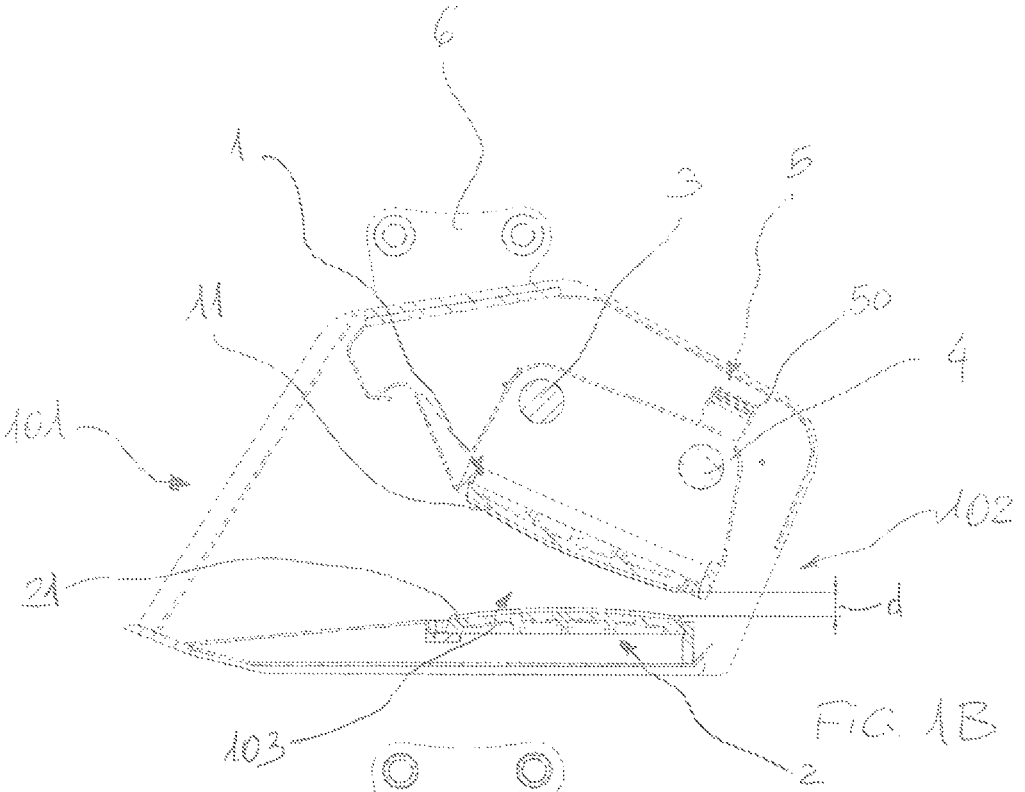
FIGS. 1A and 1B are a side view and a cross-section of a crusher bucket according to the present invention, respectively.
Figure 1A:
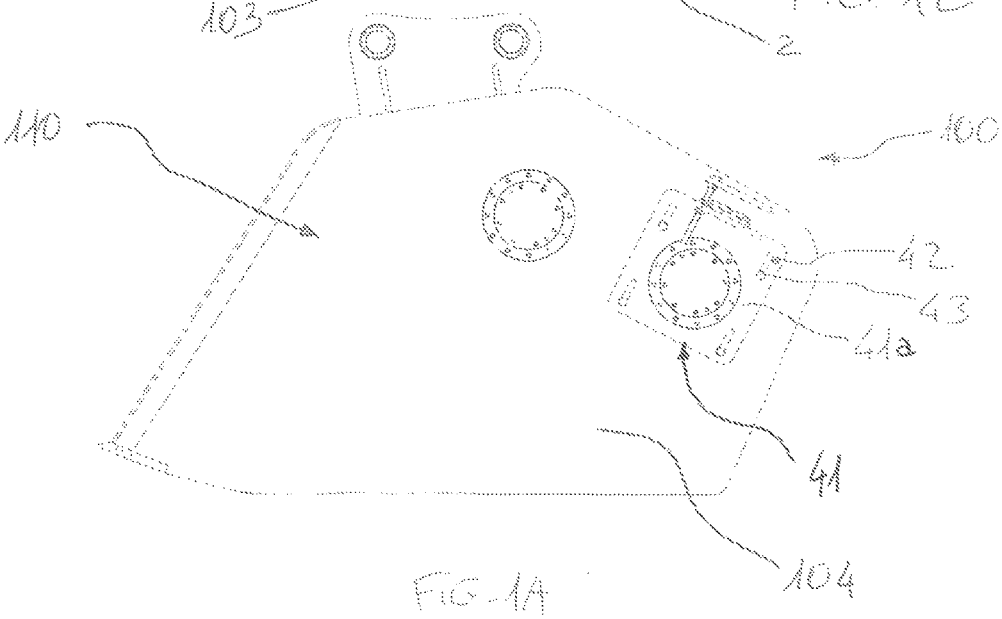

Initially with reference to FIGS. 1A and 1B, a crusher bucket according to the present invention is generally designated 100.

The bucket 100 comprises an outer casing 110 which is preferably spoon-shaped and in which there are provided attachments 6 for engaging the bucket 100 at the free end of an arm of an operating machine (not illustrated).

There are defined in the casing 110 an inlet 101 for charging crushed stone or other material to be crushed, typically stone material, and an opposite discharge 102 for discharging the processed material, after the crushing operation.

There are mounted in the casing 110 elements for crushing the crushed stone, preferably comprising a movable jaw 1 and an opposing fixed jaw 2, which is fixedly joined to the casing 110.

According to a preferred embodiment, there are removably fixed to the jaws 1 and 2 respective plates 11, 21 which are preferably suitably grooved and which are capable of facilitating the crushing action.

The bucket 100 further comprises a movement device, which is not illustrated in the Figures and which acts on the movable jaw 1 in order to move it away from and towards the fixed jaw 2 in accordance with a suitable trajectory so as to crush the material present between the jaws.

The movement device preferably comprises a pair of eccentric shafts 3, 4 which are supported on the side walls 104 of the casing 110 in a rotatable manner. The rotation of the eccentric shafts brings about in the movable jaw 1 a pivoting movement in accordance with a quadrilateral linkage mechanism.

The jaws 1 and 2 define inside the bucket 100 a crushing zone 103, which is laterally delimited by the opposing walls 104 of the casing 110 on which the eccentric shafts 3 and 4 are supported.

Figure 5A:
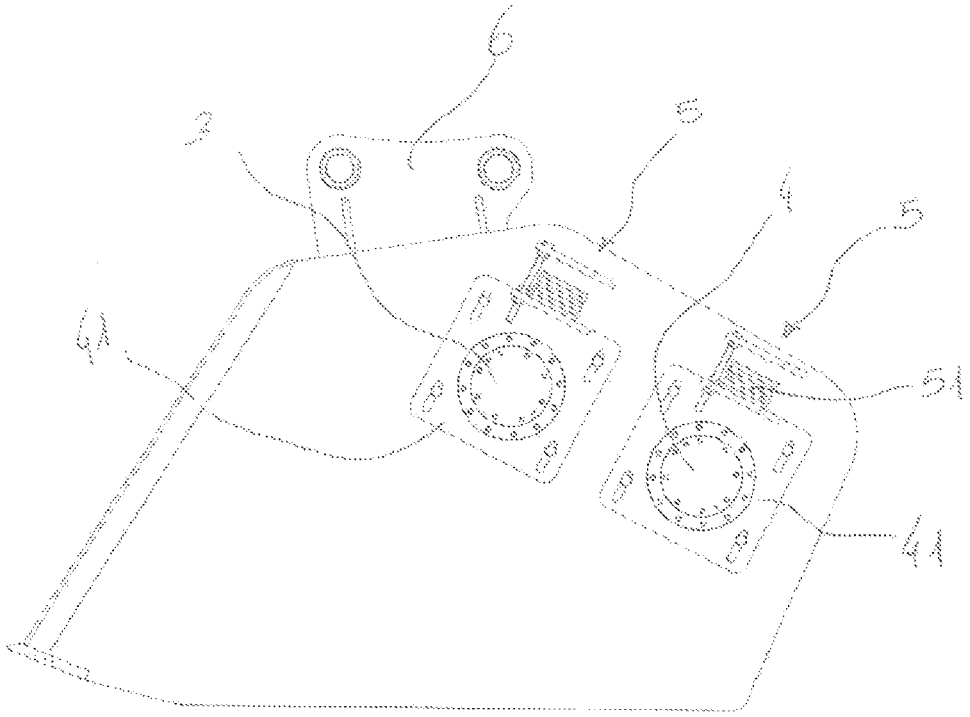
FIGS. 5A and 5B are a side view and a lateral section of the crusher bucket of FIGS. 4A, B, respectively, in which the distance between the fixed jaw and the movable jaw has been varied.
Figure 5B:
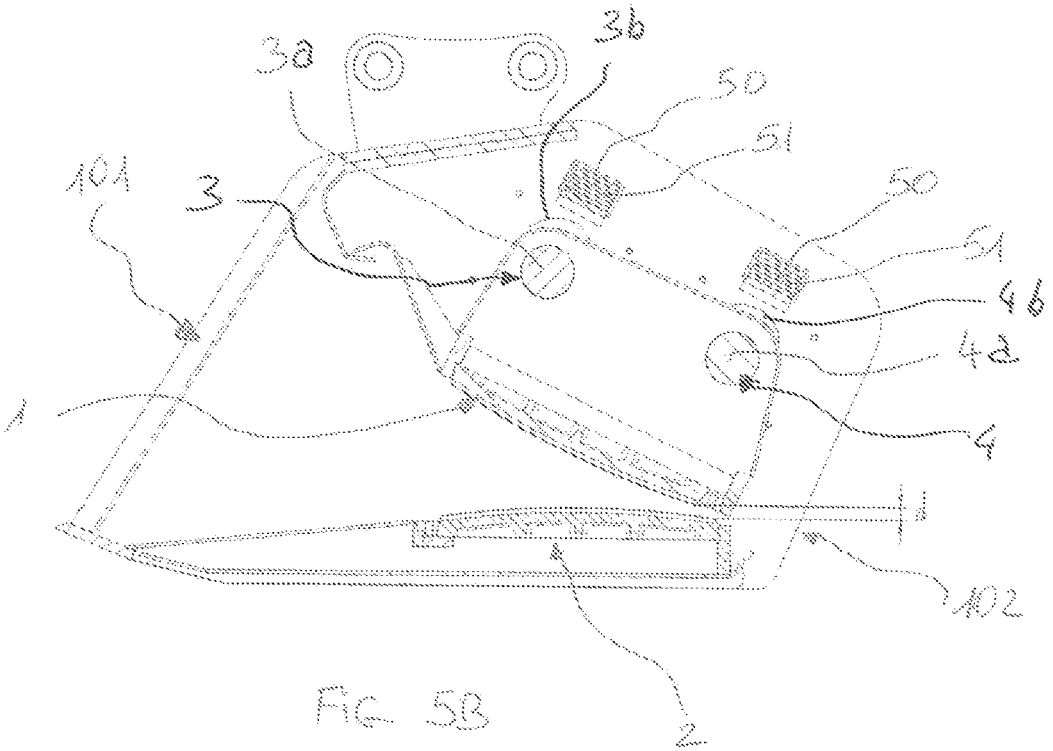
Figure 6A:
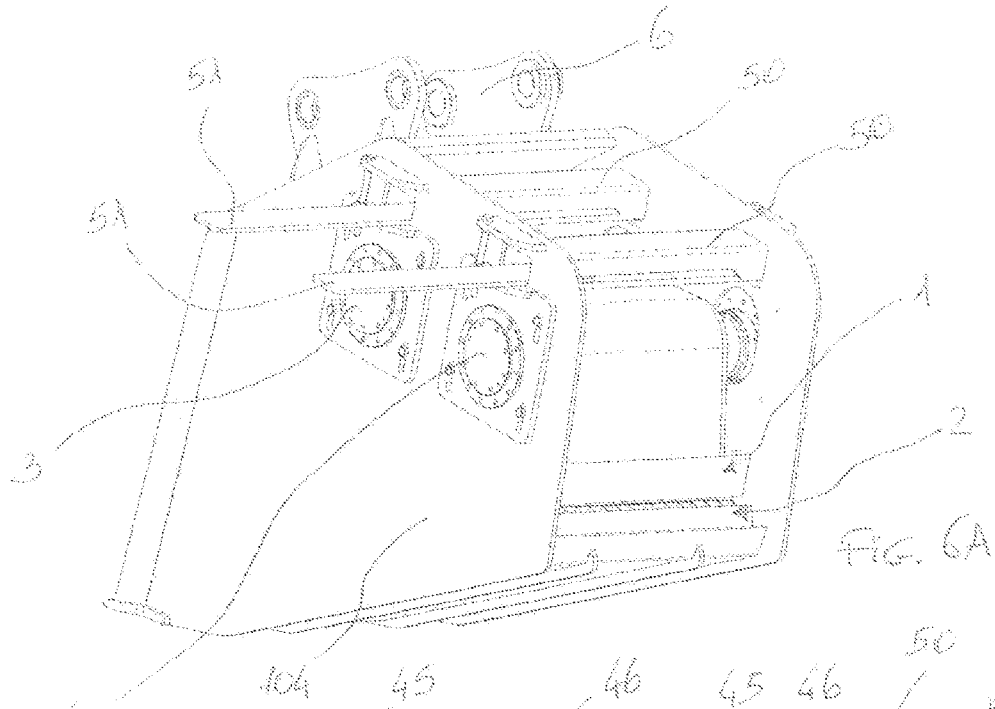
FIGS. 6A and 6B are two perspective views which illustrate the operation for varying the distance between the fixed jaw and the movable jaw in the bucket in FIGS. 4A, B.
Figure 6B:
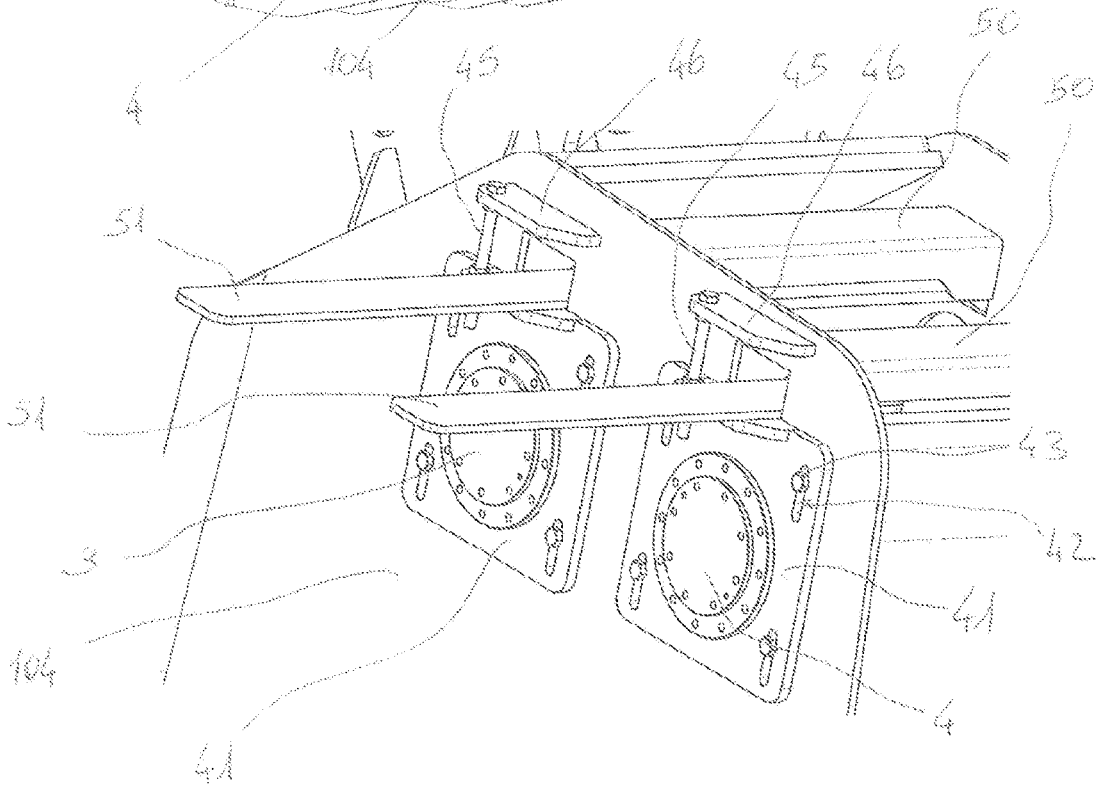
Figure 7:
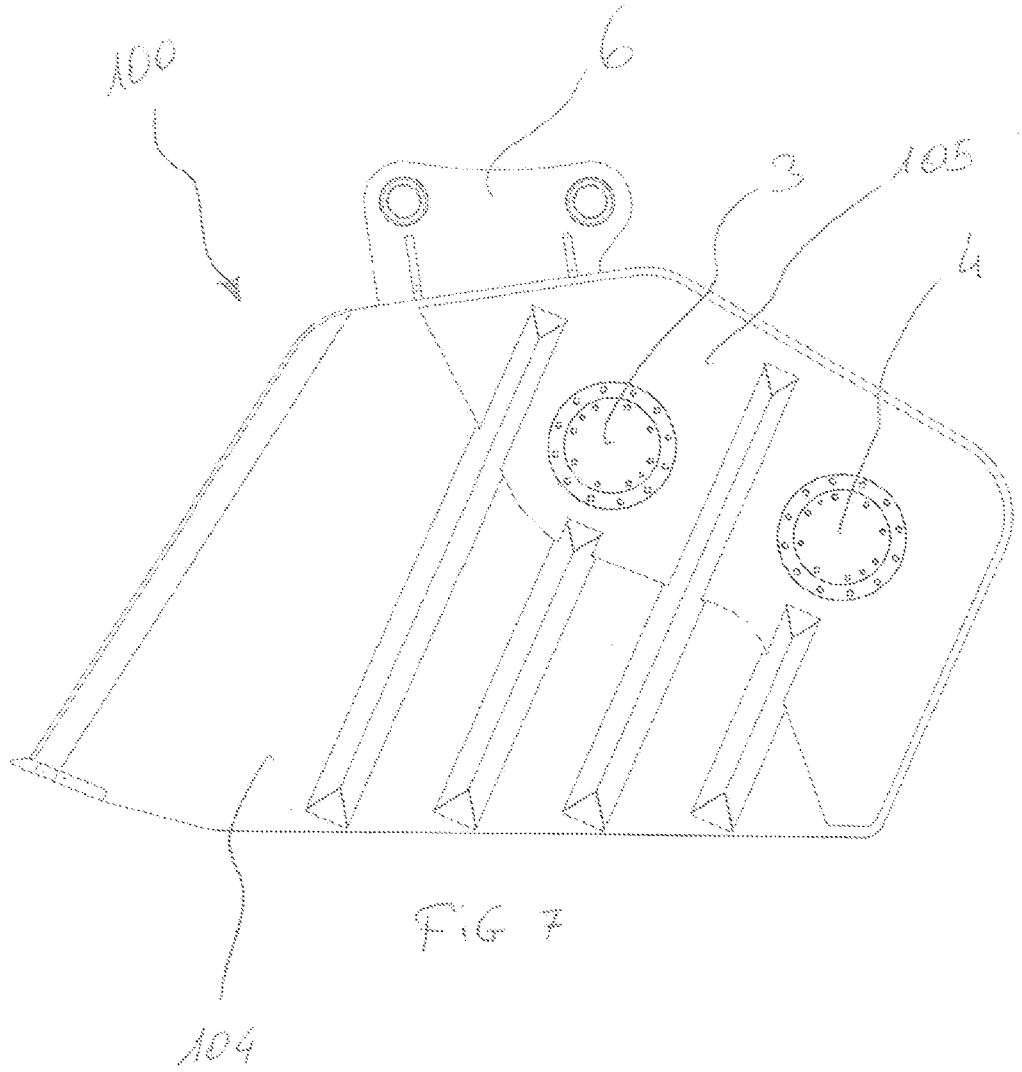
FIG. 7 is a side view of another construction variant of the bucket according to the present invention.
Figure 8A:
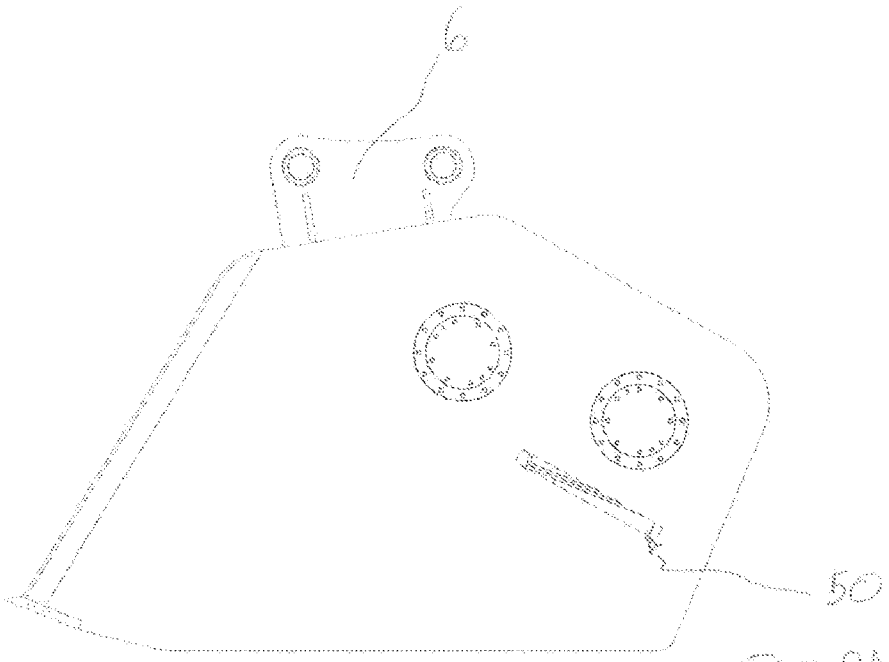
FIGS. 8A and 8B are a side view and a lateral section of a crusher bucket in accordance with another embodiment, respectively.
Figure 8B:
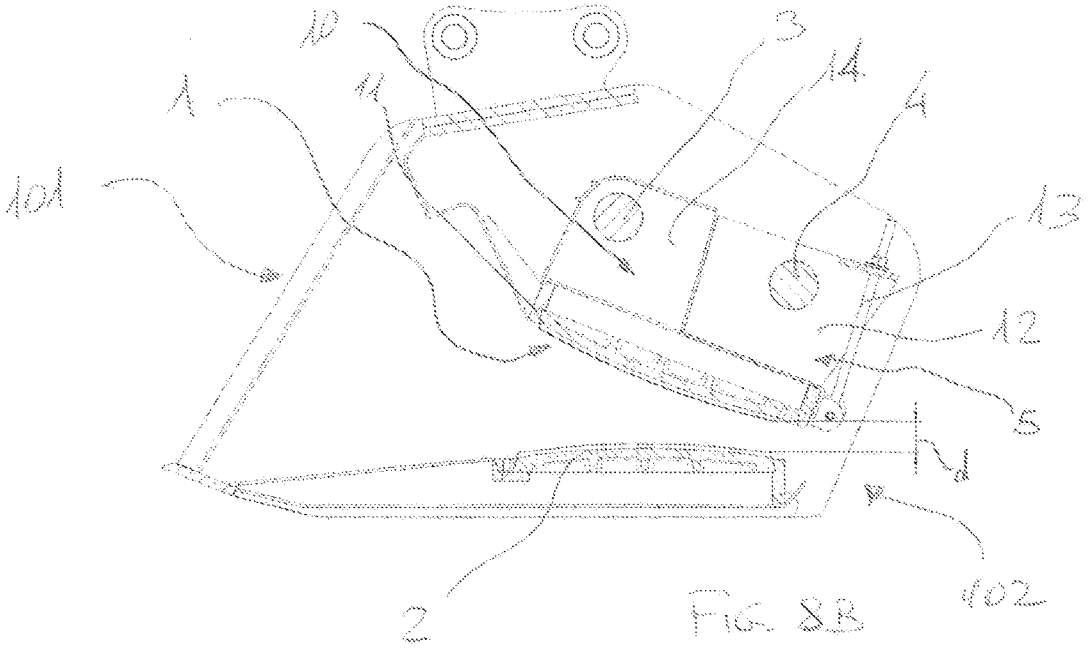
Figure 9A:
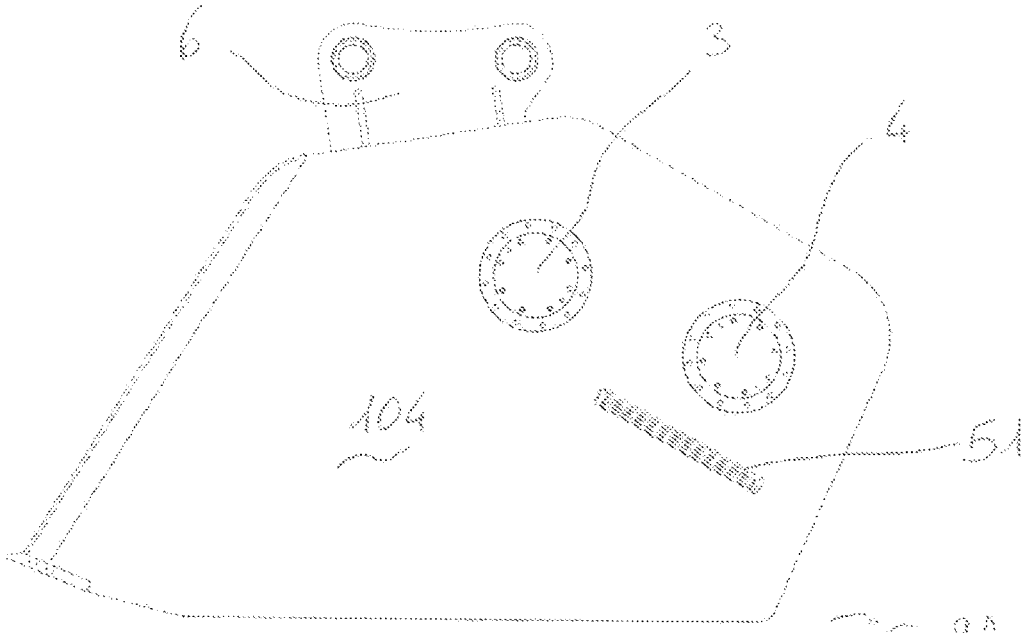
FIGS. 9A and 9B are a side view and a lateral section of the crusher bucket of FIGS. 8A, B, respectively, in which the distance between the fixed jaw and the movable jaw has been varied.
Figure 9B:
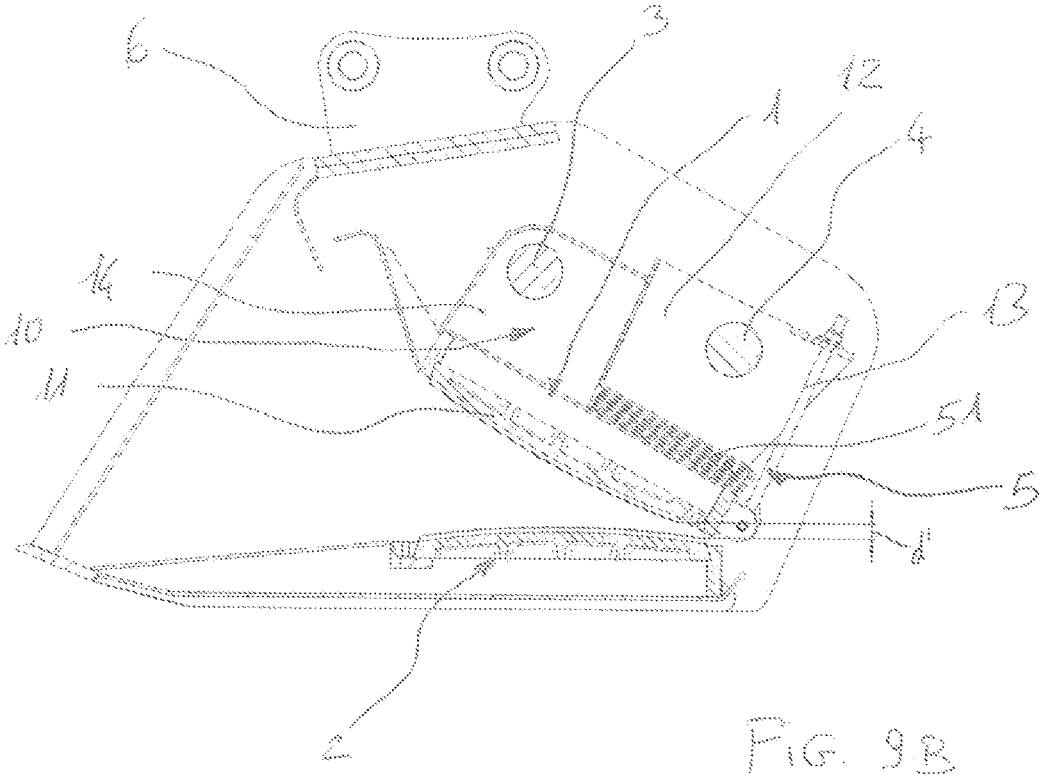
Figure 10A:
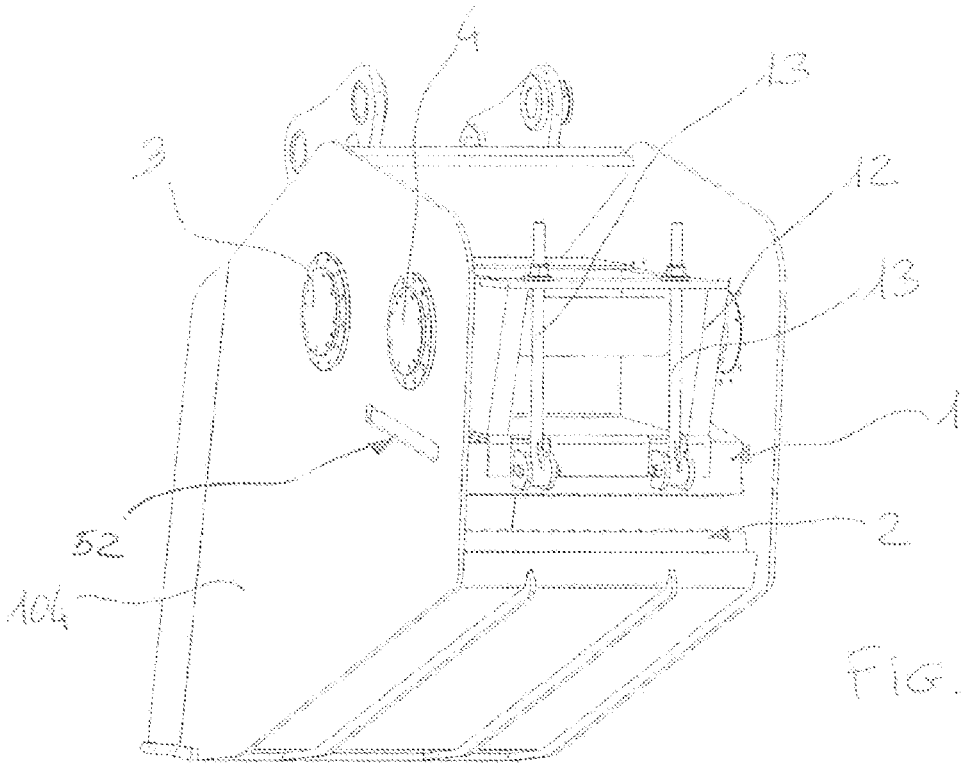
FIGS. 10A and 10B are two perspective views of the bucket of FIGS. 8A, B.
Figure 10B:
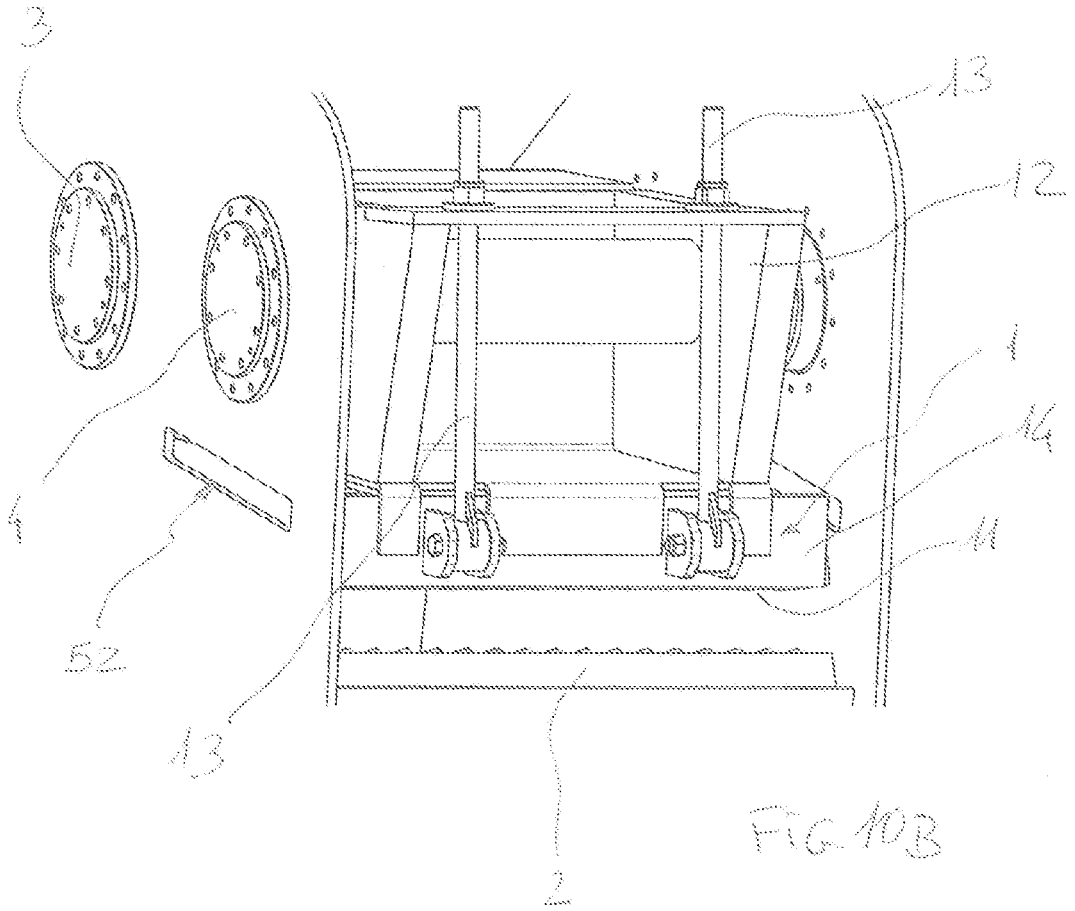
Figure 11A:
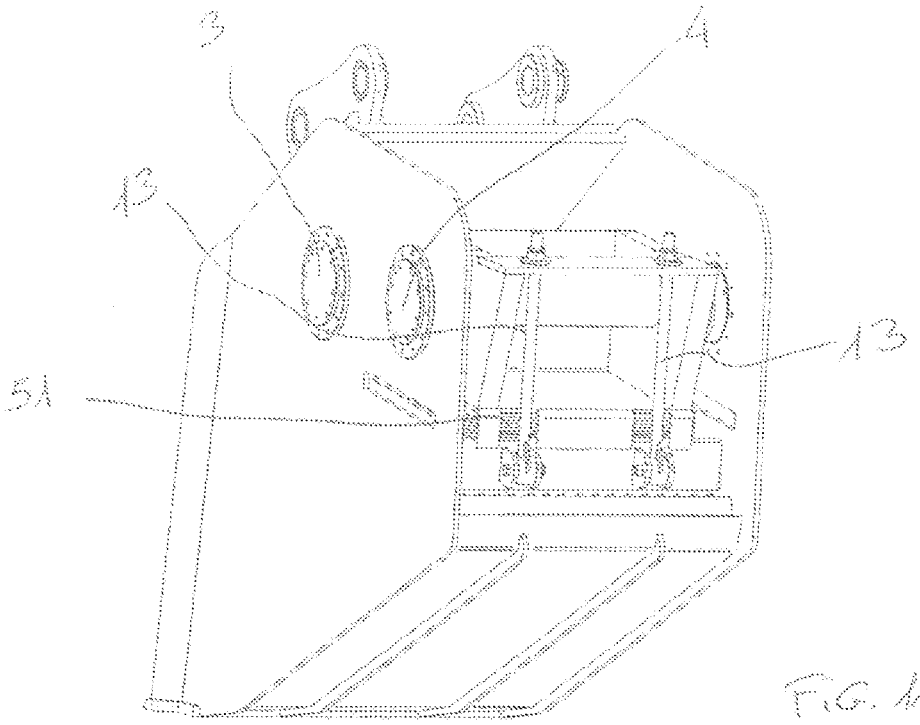
FIGS. 11A and 11B are two perspective views of the bucket of FIGS. 9A, B.
Figure 11B:
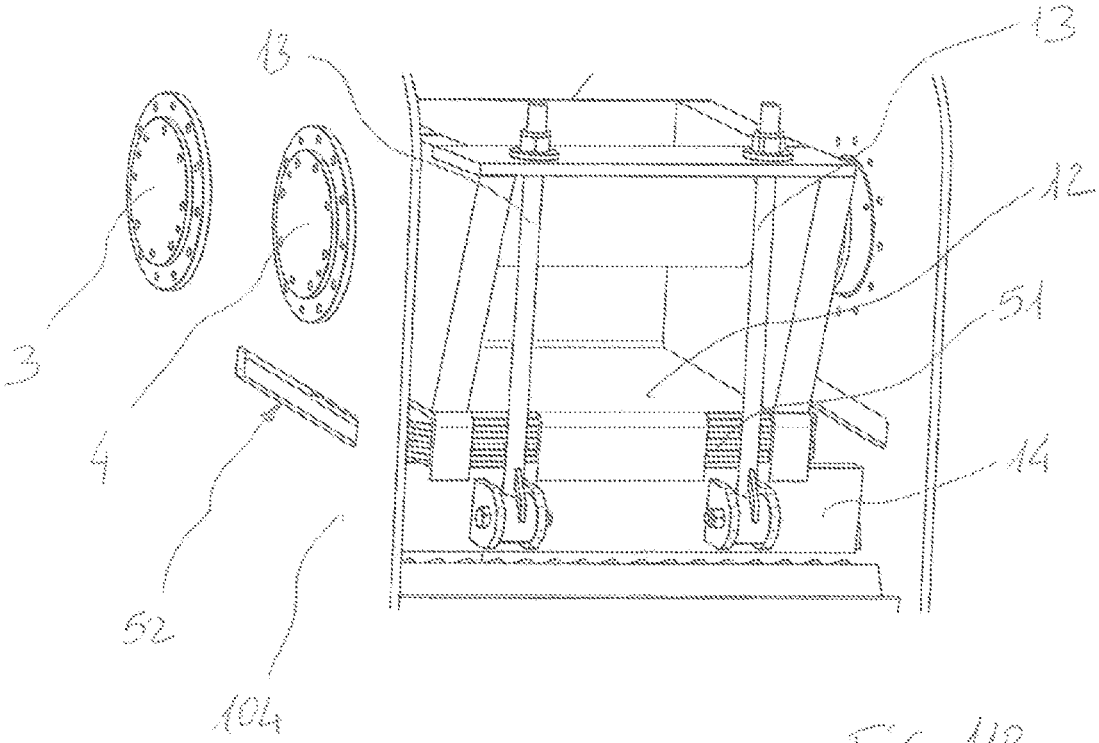
Figure 12:
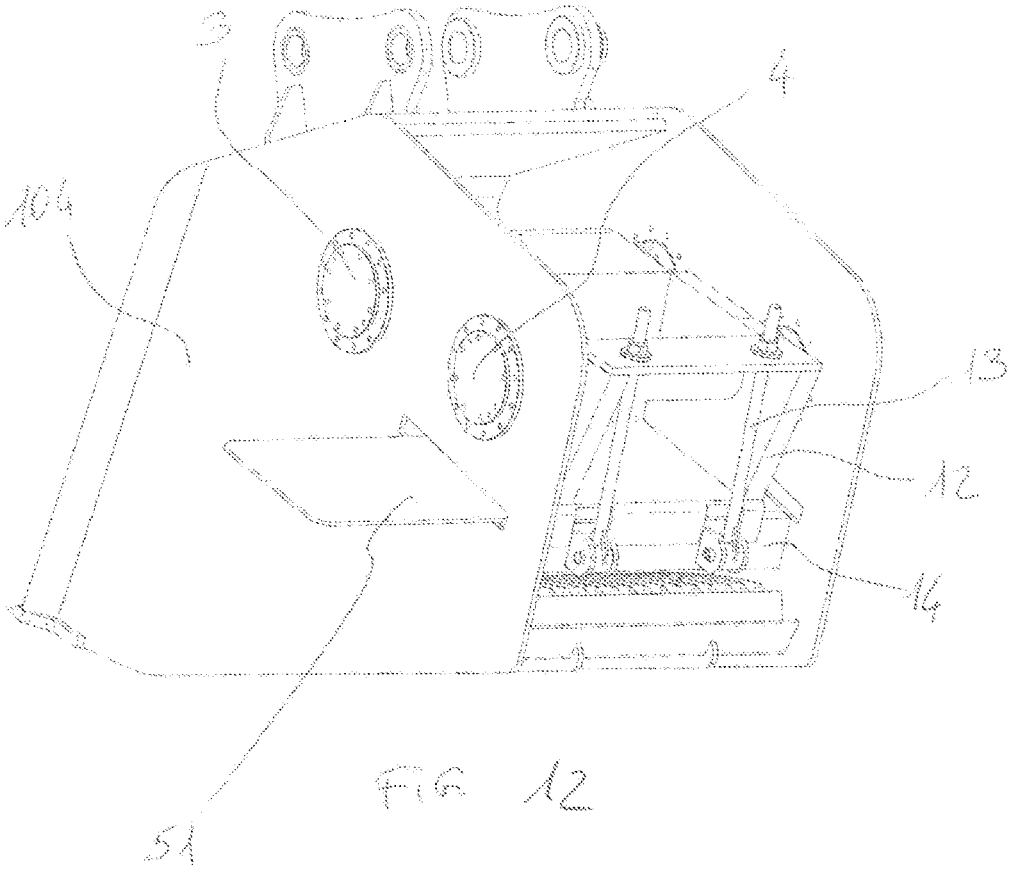
FIG. 12 is a perspective view which illustrates the operation for varying the distance between the fixed jaw and the movable jaw in the bucket of FIGS. 8A, B.
Figure 13A:
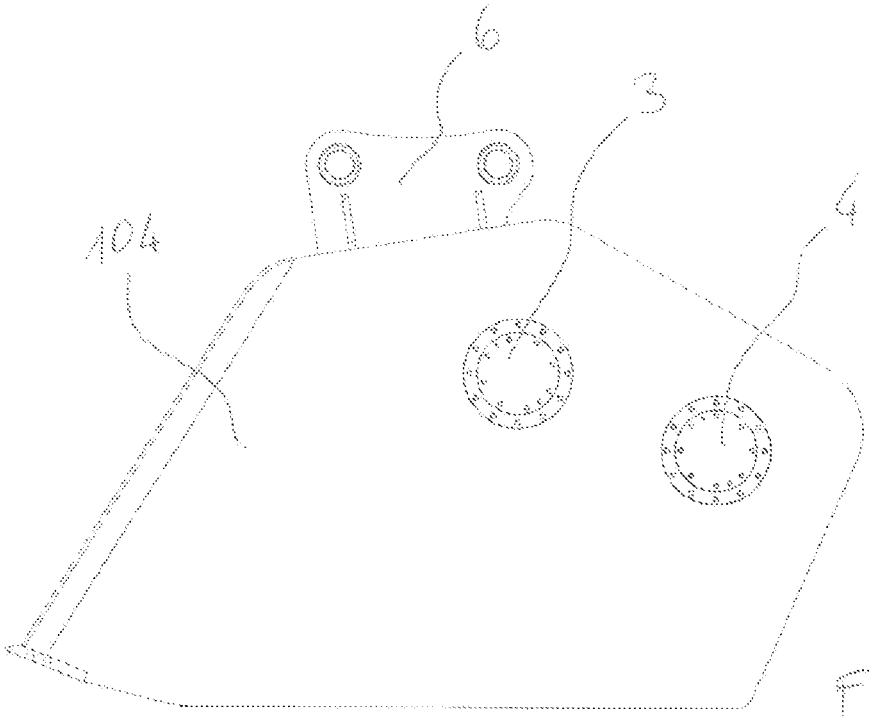
FIGS. 13A and 13B are a side view and a lateral section of a crusher bucket in accordance with another embodiment, respectively.
Figure 13B:
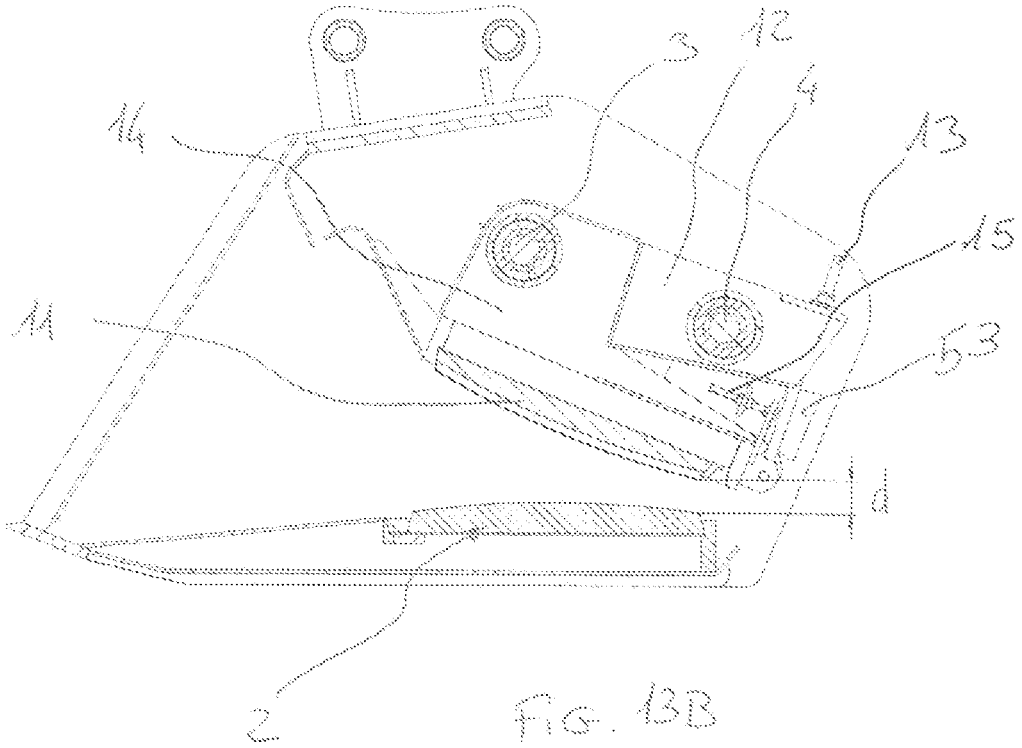
Figure 14A:
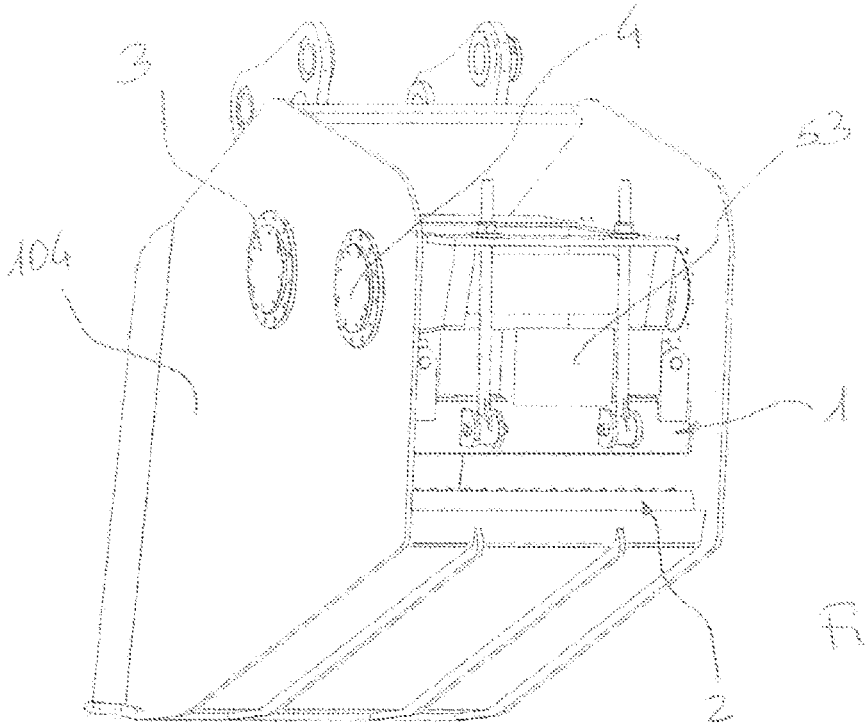
FIGS. 14A and 14B are two perspective views of the bucket of FIGS. 13A, B.
Figure 14B:
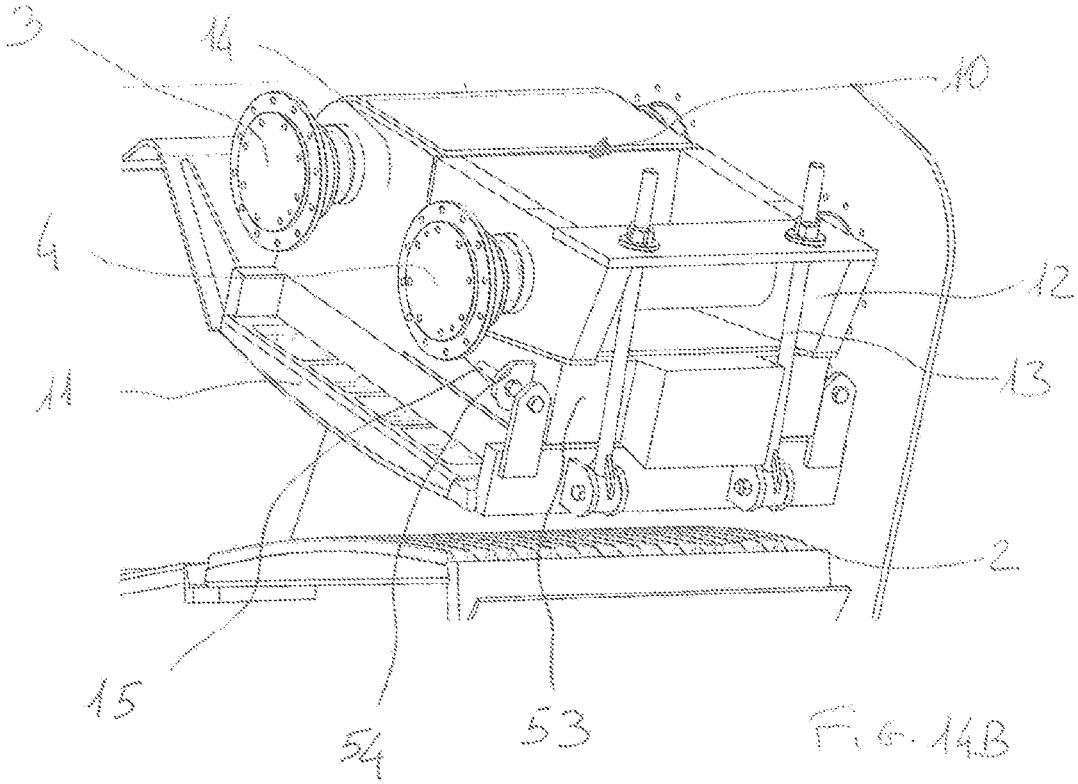
Figure 15A:
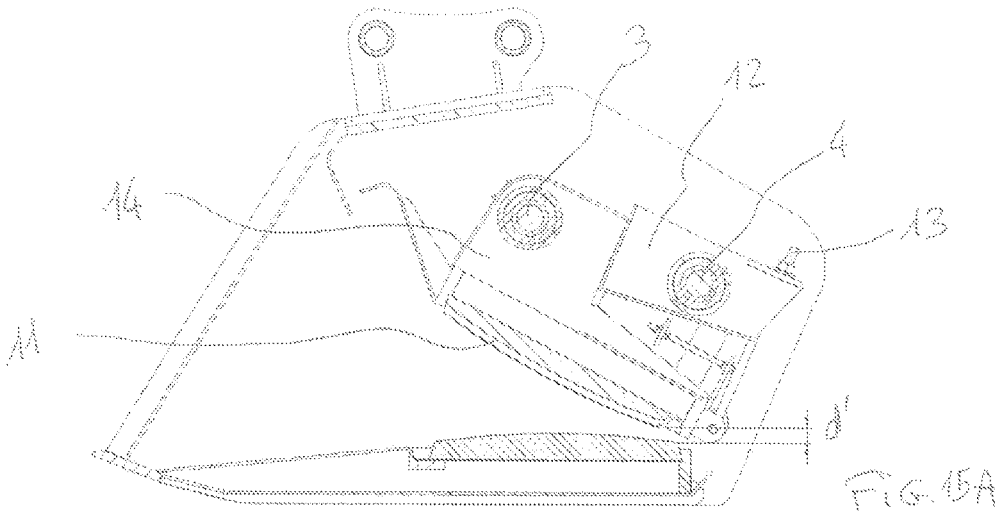
FIGS. 15A and 15B are a side view and a lateral section of the crusher bucket of FIGS. 13A, B, respectively, in which the distance between the fixed jaw and the movable jaw has been varied.
Figure 15B:
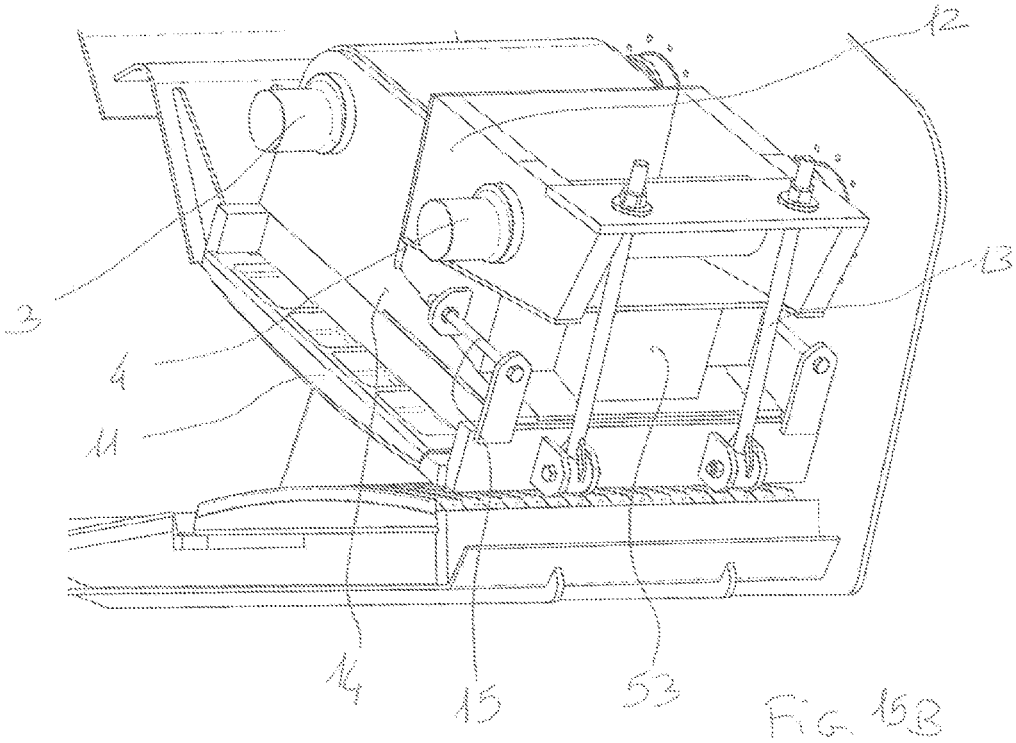
Figure 16:
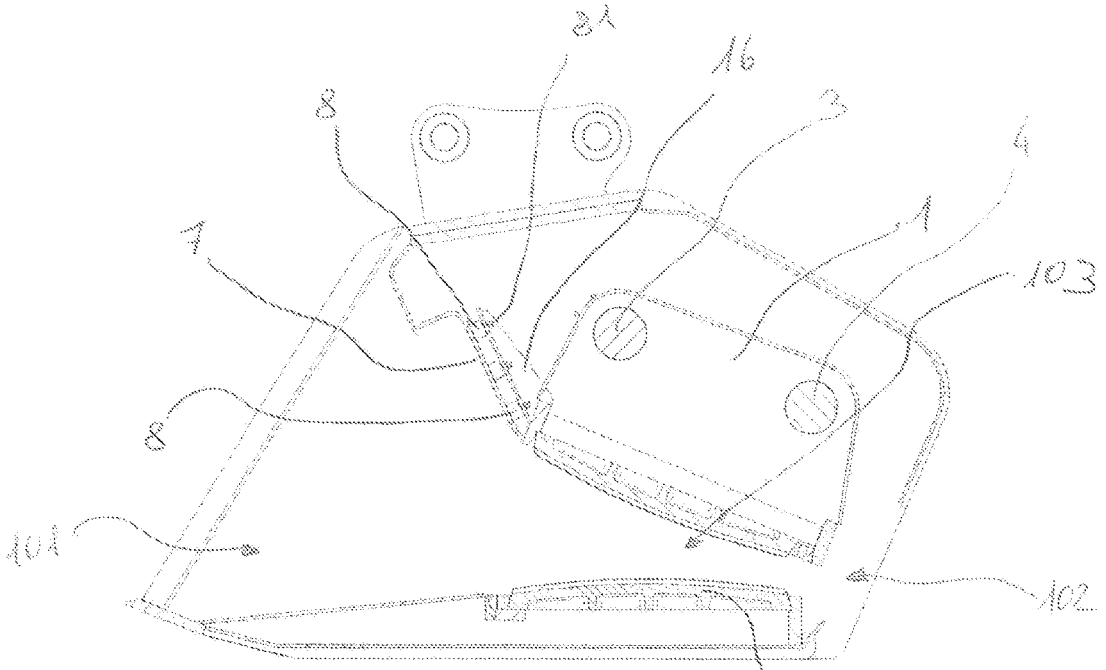
FIG. 16 is a sectioned view of a bucket which is constructed in accordance with another aspect of the present invention.
Figure 17:
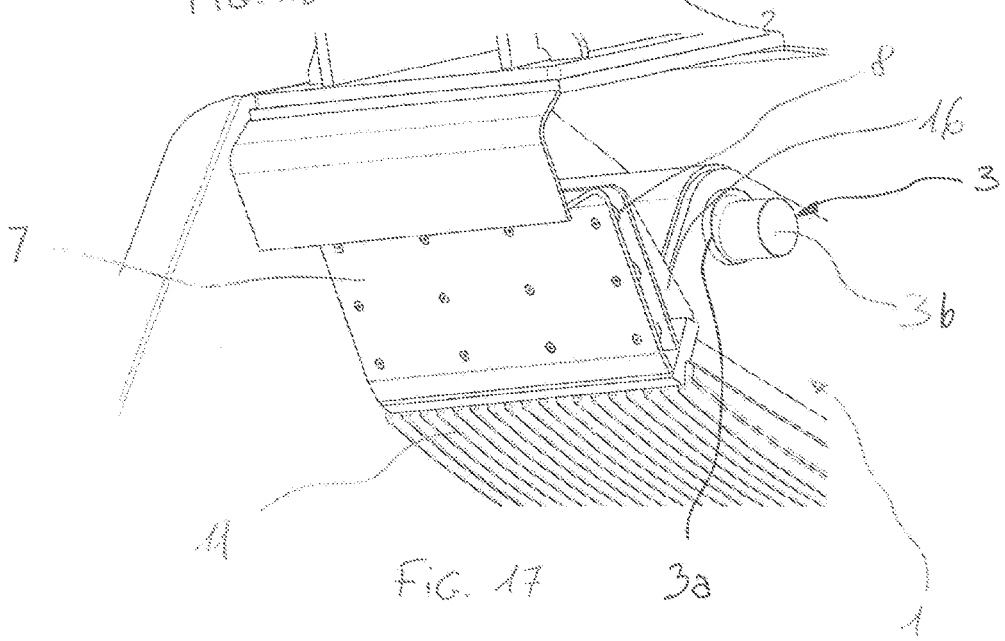
FIG. 17 is a perspective view which illustrates a detail of the bucket of FIG. 16.
Figure 18:
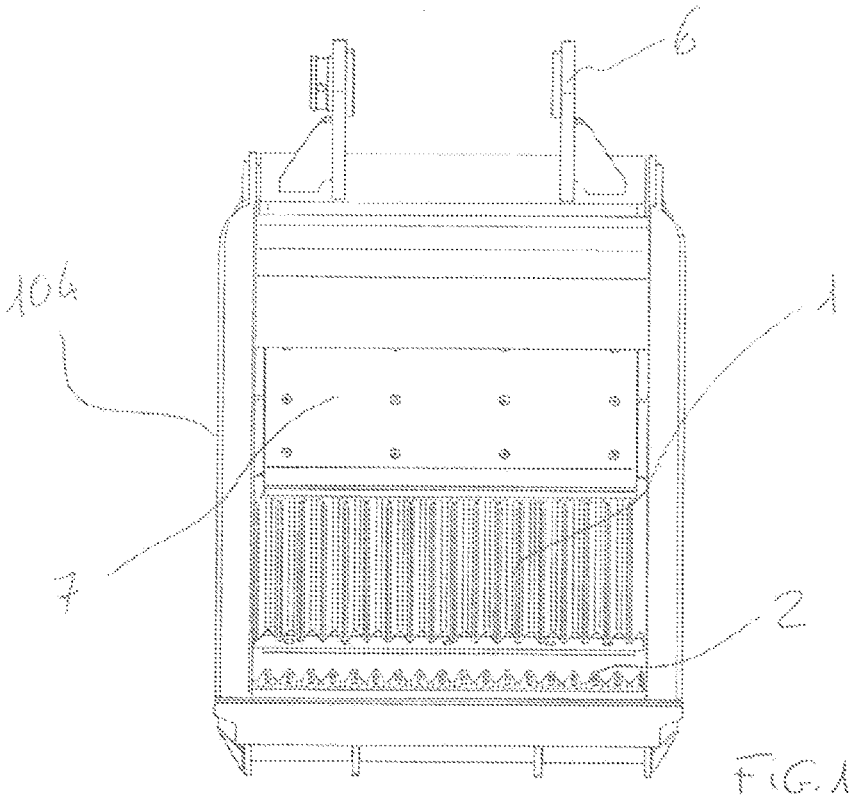
FIG. 18 is a front view of the bucket of FIG. 16.
Figure 19:
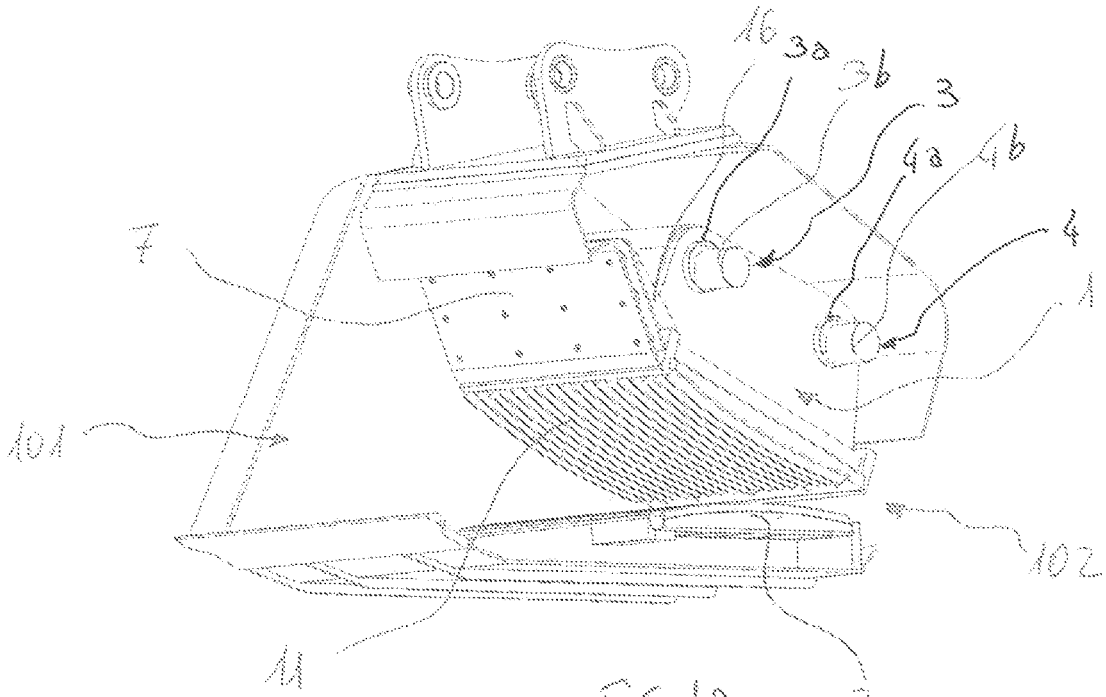
FIG. 19 is a perspective, partially sectioned view which illustrates the bucket of FIG. 16.
Figure 20:
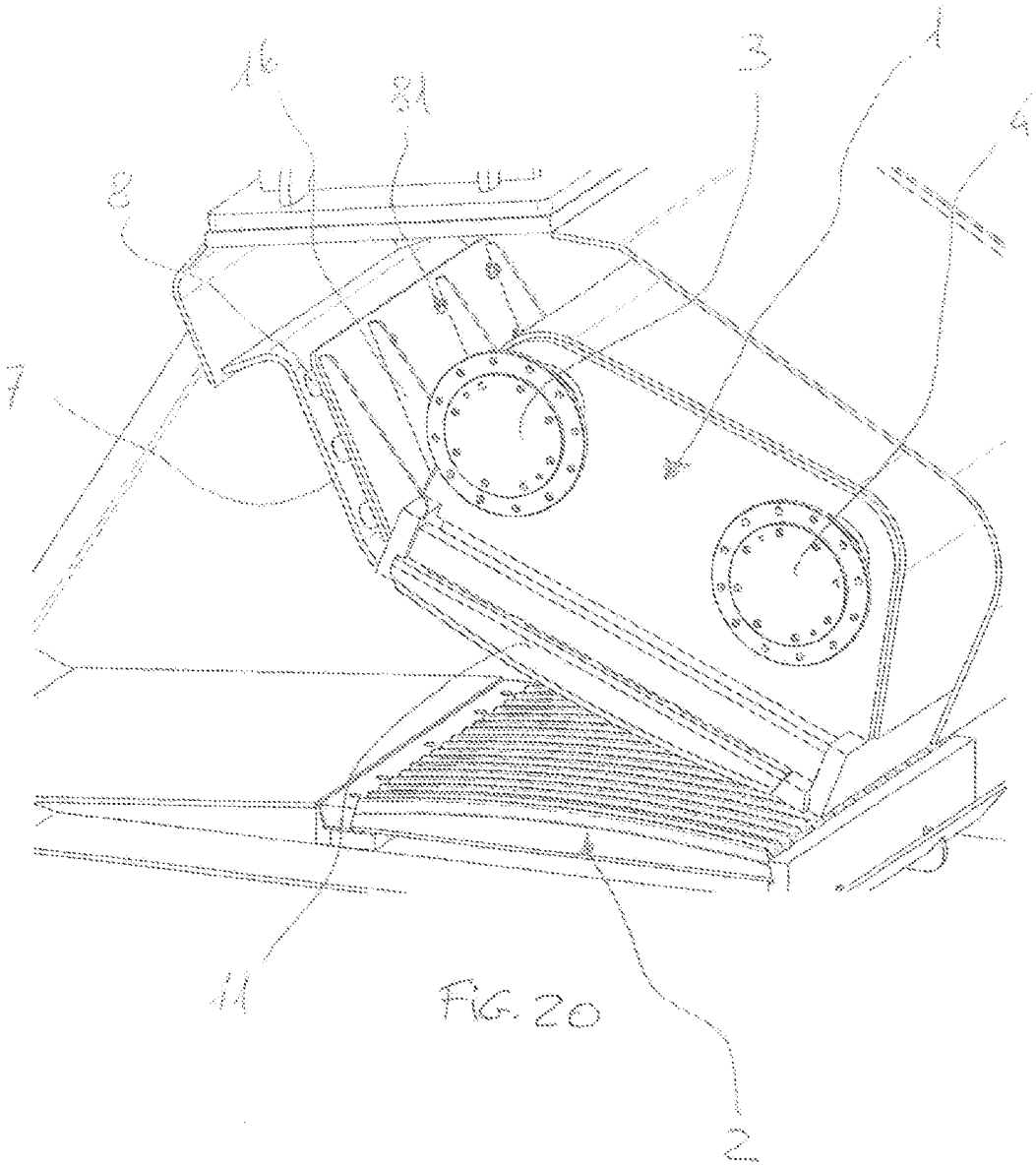
FIG. 20 is a perspective, sectioned view which illustrates a detail of the bucket of FIG. 16.

Preferably, the eccentric shafts 3, 4 comprise a central portion 3*a*, 4*a* and end portions 3*b*, 4*b* which are eccentric with respect to the central portion 3*a*, 4*a*, which can be seen, for example, in FIGS. 5B, 17 and 19.

In one embodiment, the movable jaw 1 is supported on the central portion 3*a*, 4*a* and the end portions 3*b*, 4*b* are supported on the opposing walls 104 of the casing 110. In the present embodiment, one of the two eccentric shafts, mainly the rear eccentric shaft 4, that is to say, the one which is nearest the discharge 102, is supported in a movable manner to the casing 110.

To that end, the bucket according to the present invention comprises an adjustment device 5 for the distance d between the movable jaw and the fixed jaw in the region of the discharge 102.

In the present type of adjustment, the adjustment device 5 comprises a movable support 41 which is fixed in a movable manner to the side walls 104 of the casing 110, to which there is in turn rotatably connected the rear eccentric shaft 4.

Preferably, the movable support 41 comprises a support plate 41*a*.

In an embodiment, the end portions 3*b*, 4*b* are supported on the side walls 104 by means of the movable support 41.

Figure 3A:
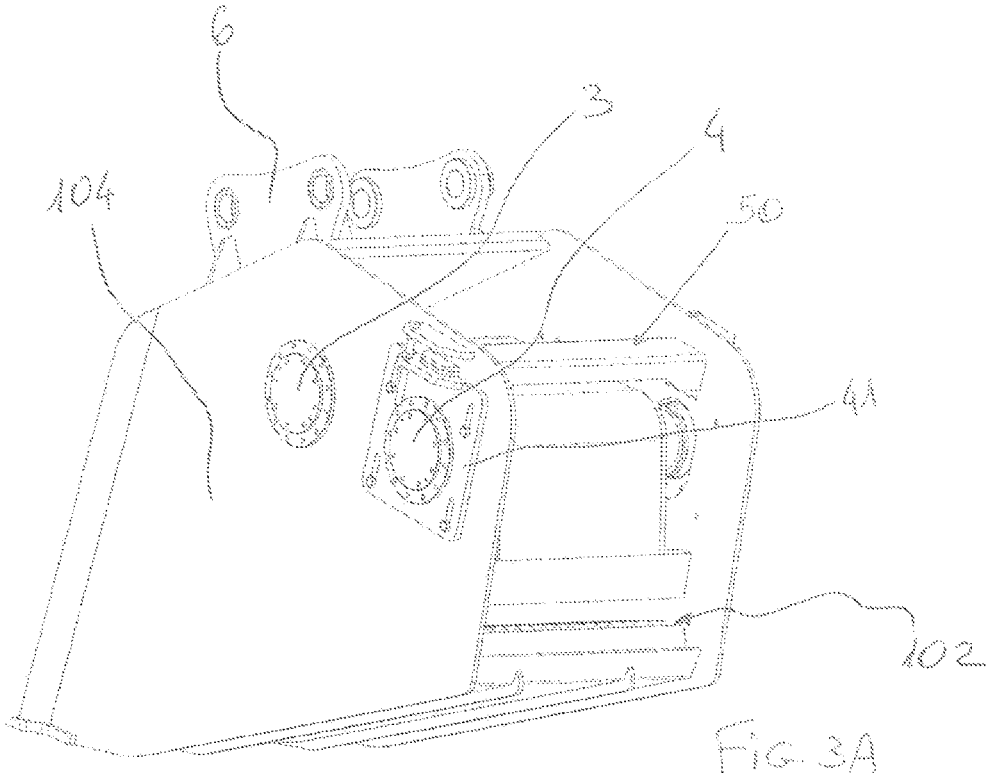
FIGS. 3A and 3B are two perspective views which illustrate the operation for varying the distance between the fixed jaw and the movable jaw.
Figure 3B:
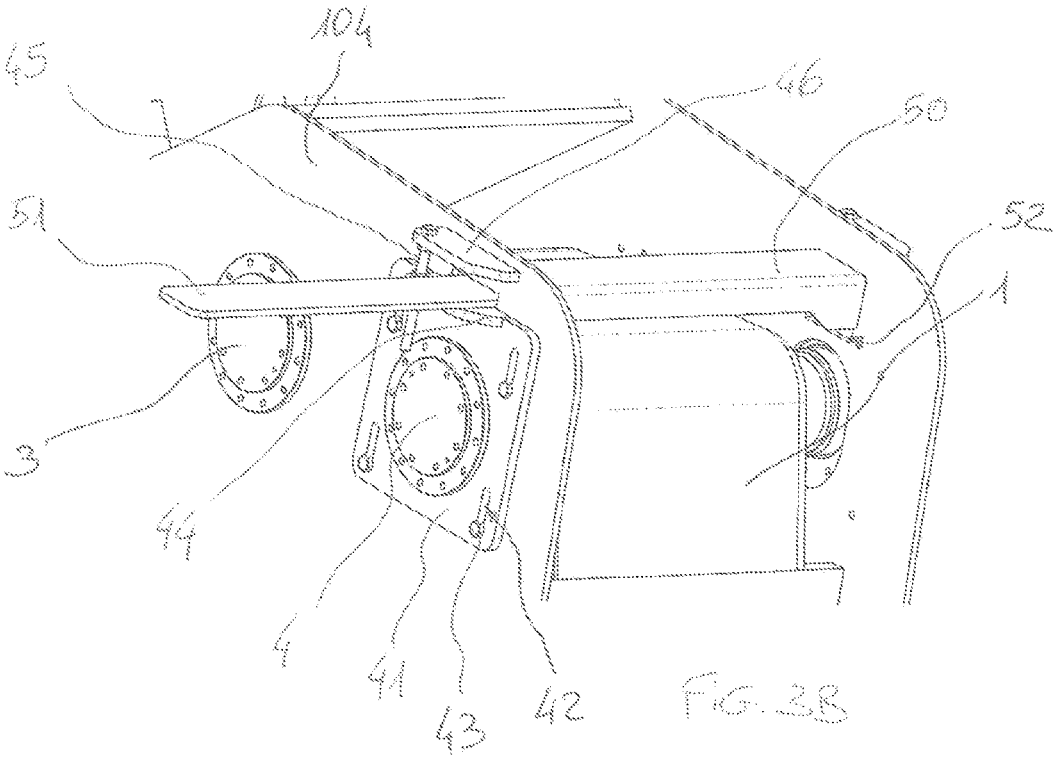
Figure 4A:
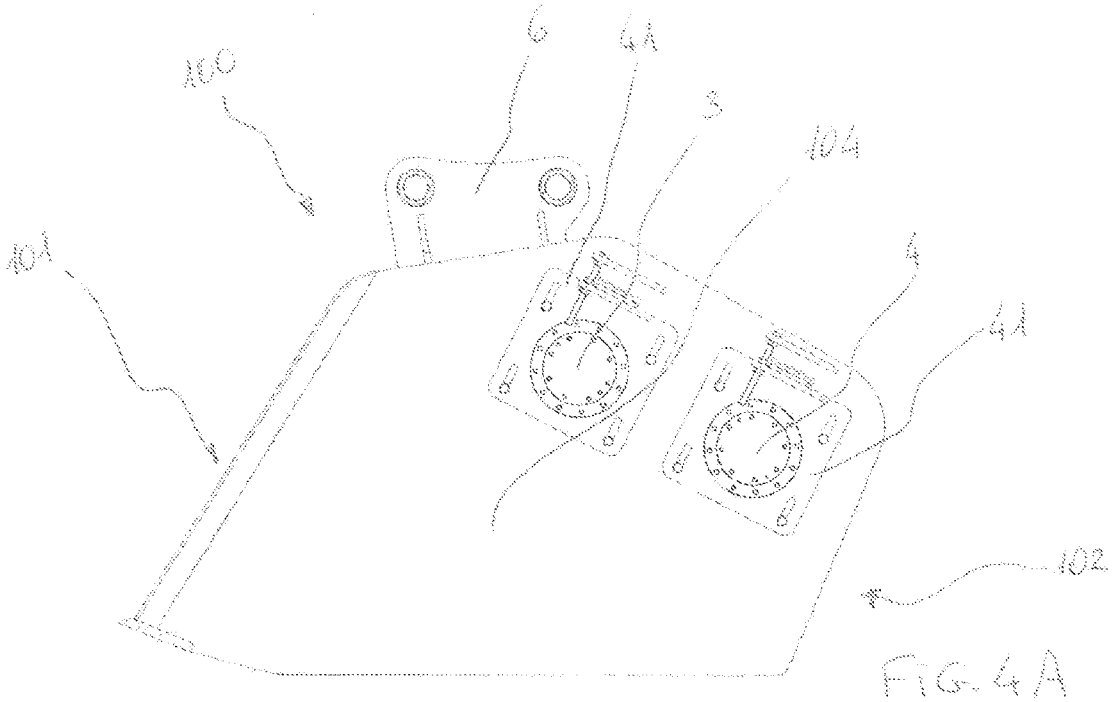
FIGS. 4A and 4B are a side view and a lateral section of a crusher bucket in accordance with a second embodiment, respectively.
Figure 4B:
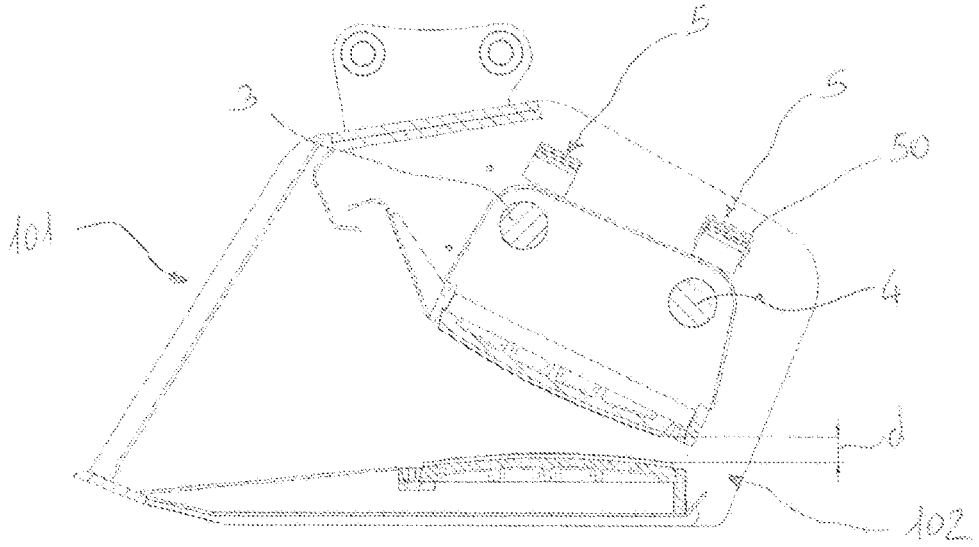

Now also with reference to FIGS. 3A and 3B, the movable support 41 preferably comprises guides 42, which can slide on respective pins 43 which are connected to the side walls 104. In any case, it is evident that alternatively the pins could be connected to the movable support 41 and the guides could be connected to the side walls.

In this manner, the position of the eccentric shaft 4 can be varied, moving it towards or away from the fixed jaw 2.

The position of the movable support 41 can be fixed in the desired position.

To that end, the adjustment device 5 further comprises at least one spacer which is or can be arranged between an abutment element 50 which is rigidly connected to the casing 110, preferably in the region of the side walls 104, and the movable support.

It should be noted that the abutment element 50 is preferably arranged above the eccentric shaft 4, thereby allowing adjustment of the upper position, that is to say, the position in the direction moving away with respect to the fixed jaw 2.

According to a preferred embodiment, the movable support 41 comprises an extension 44, which is preferably connected to the plate 41*a* and which projects laterally with respect to the surface of the plate 41*a*, which allows the provision of a greater abutment surface for the spacers 51.

However, the position of the eccentric shaft 4 is adjusted in the lower region by means of an adjustment element, preferably produced by means of an adjustment screw 45 which is engaged in respective portions of the movable support 41 and the casing 110. Preferably, the adjustment screw 45 engages with the extension 44 itself and with another extension 46 which is connected to the side wall 104.

According to a preferred embodiment, in order to insert one or more spacers 51 between the movable support 41 and the abutment element 50, there is/are defined at least one through-opening 52 in the side wall 104.

In this manner, by increasing or decreasing the number of spacers 51 which are arranged between the plate and the abutment element 50 and adjusting the position of the adjustment element 45, it is possible to vary the position of the eccentric shaft 4, adjusting the distance d between the fixed jaw 2 and the movable jaw 1, in particular in the region of the discharge 102.

Figure 2B:
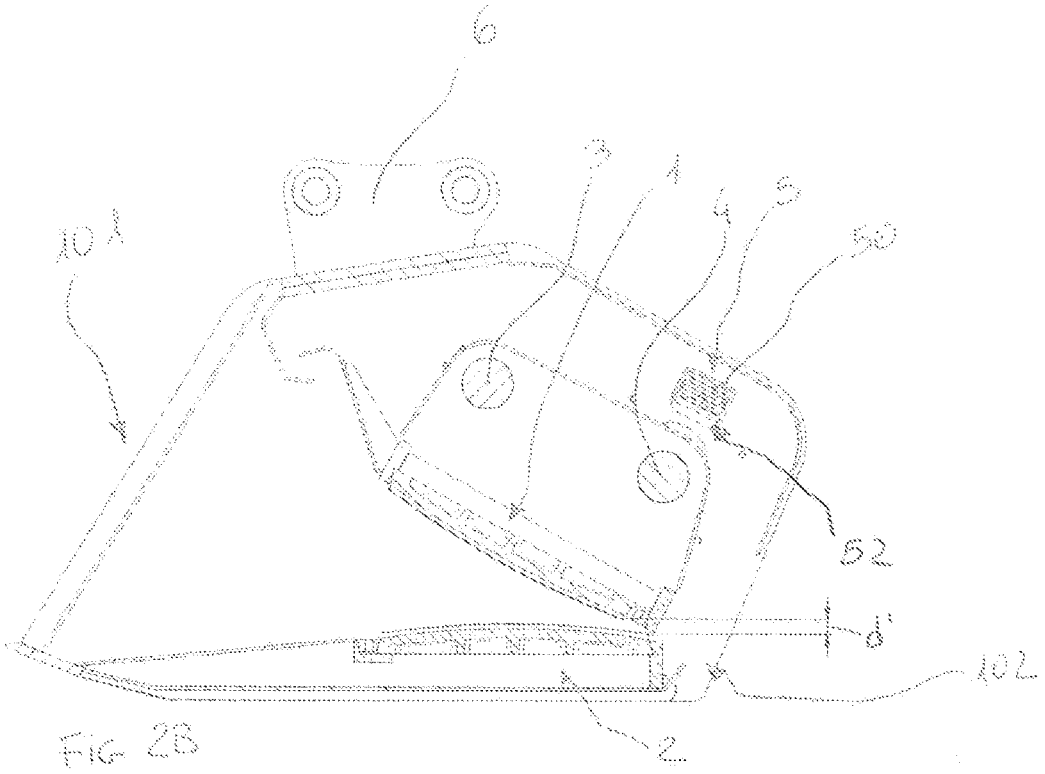
FIGS. 2A and 2B are a side view and a cross-section of the crusher bucket of FIGS. 1A, B, respectively, in which the distance between the fixed jaw and the movable jaw has been varied.
Figure 2A:
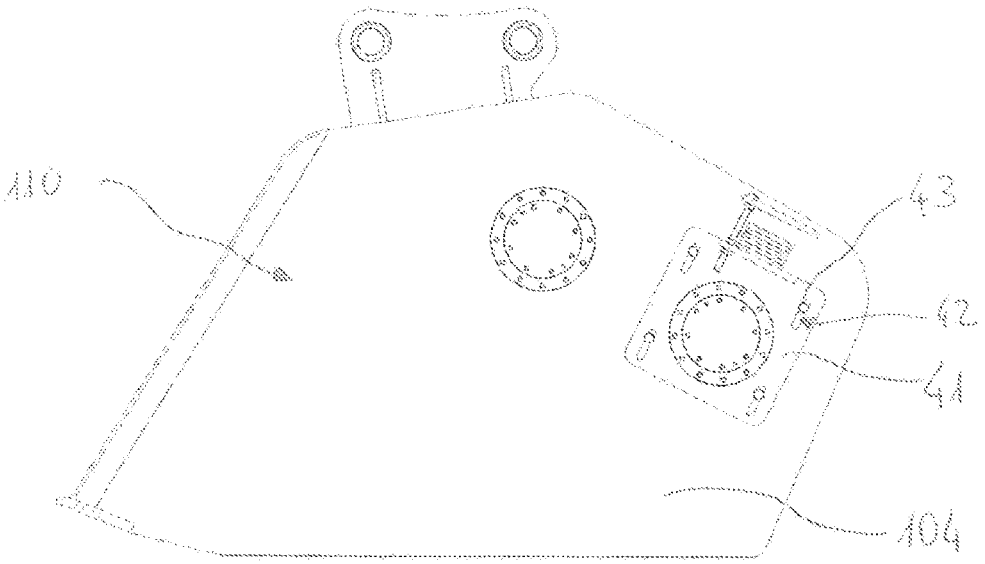

For example, FIGS. 2A and 2B illustrate the operation of the present invention in which, by selecting a greater number of spacers 51, the distance d' between the fixed jaw 2 and the movable jaw 1 in the region of the discharge 102 is reduced with respect to the distance d of the operating condition of FIG. 1B.

In any case, it is evident that, alternatively to a greater number of spacers, there could also be selected a spacer having different dimensions, obtaining the same technical effect.

According to an alternative embodiment which is illustrated in FIGS. 4A-6B, the adjustment device 5 can be selected both in the region of the rear shaft 4 and in the region of the front shaft 3.

Preferably, each of the eccentric shafts comprises a plate 41*a* with characteristics similar to those described with reference to the preceding embodiment. Alternatively, there could also be used other movable supports 41.

Similarly, the adjustment and fixing of each plate 41*a* is carried out in a manner similar to that previously described.

That embodiment allows independent control of the position of the front shaft 3 and the rear shaft 4.

According to another construction variant which is not illustrated in the Figures, the front shaft 3 and rear shaft 4 can be fixed to a single plate, therefore being adjustable in a simultaneous manner.

According to another construction variant, which is illustrated in FIGS. 7A-12, the adjustment device 5 is arranged in the region of a support portion 10 of the movable jaw 1.

Preferably, the support portion 10 comprises a first portion 14 and a second portion 12 which are connected to the eccentric shaft 3 and the eccentric shaft 4, respectively.

The plate 11 is connected to one of the two portions, preferably the first portion 14.

The first and second portions are movable relative to each other and, in particular, the lower base of the second portion 12 can be moved away from a respective abutment surface with respect to the first portion 14.

In this manner, one or more spacers 51 can be arranged between the first portion and the second portion, thereby moving the rear portion of the movable jaw away with respect to the rear eccentric shaft 4.

Therefore, the distance between the fixed jaw and movable jaw is consequently varied, in particular in the region of the discharge 102.

In this case, there is also provided at least one adjustment screw 13, two in the present embodiment, which extend(s) between the first portion and the second portion and is engaged in respective portions so as to adjust the distance thereof.

In any case, it is evident that the adjustment screw only serves to adjust the distance, the stresses generated by the crushing of the material being transmitted by means of the spacers and supported by the eccentric shafts 3 and 4.

According to a preferred embodiment, the adjustment screws are rotatably connected to the first portion and are engaged by means of a threaded element in the second portion, or vice versa.

In this case, there is also provided an opening 52 which is constructed in the wall 104 of the casing 100 for the insertion of the spacers 51.

Advantageously, the present embodiment allows the use of lateral reinforcement plates 105, on which there are supported the eccentric shafts 3 and 4 and which cooperate with the wall 104 in order to support the stresses which result from the crushing of the material.

In any case, it is evident that those plates could also be selected in the preceding embodiment, even in a single eccentric shaft and, as will become evident below, in the following embodiments.

On the basis of another embodiment which is illustrated in FIGS. 13A-15B, the spacer can be produced by means of a wedge-like member 53 which can always be inserted between the two portions of the movable jaw.

In this case, the wedge-like member 53 is preferably inserted in the region of a rear portion of the movable jaw 1.

Furthermore, according to a preferred embodiment, it further comprises another adjustment screw 15 which is engaged with the wedge-like member 53 and the first portion 14 of the movable jaw 1, respectively. The screw 15 is orientated in the insertion/withdrawal direction of the wedge-like member 53 and allows the position of the wedge-like member to be adjusted in that direction so as to prevent the tightening of the adjustment screw 13 or the stresses produced by the crushing from causing the wedge-like member 53 to be withdrawn.

Another aspect of the present invention is illustrated in FIGS. 16-20.

The bucket described in those Figures comprises a protection plate 7 which is connected to the movable jaw 1 in the region of a support element 16 and directed towards the inlet 102.

The protection plate 7 is connected to the support element 16 by means of an attenuation element 8 which allows limited movements for the protection plate with respect to the support portion.

For example, the attenuation element 8 is constructed by means of a plurality of cylinders of elastomer material or other material which is partially resilient.

In that embodiment, the protection plate 7 is further connected to the support element 16 by means of a series of screws 81, providing a given play so as not to impede those limited movements which are conferred by the attenuation element 8.

That embodiment further allows simple replacement of the protection plate 7 in the event of wear or damage.

The protection plate 7 is arranged in the region of the inlet 102 and extends as an extension of the movable jaw 7 towards the opening which defines the inlet 102.

In this manner, it is possible to produce an opening having greater dimensions though selecting a jaw having dimensions which are not excessive, given that the front portion of the casing only serves to charge the material, the subsequent crushing zone 103 being provided for the crushing of the material.

The invention thereby achieves the objects set out, further achieving a number of advantages with respect to the prior art involved, including a substantial simplicity in terms of the adjustment of the distance between the fixed jaw and movable jaw.

The invention claimed is:

1. A crusher bucket comprising a casing in which there are mounted crushing elements comprising a fixed jaw and a movable jaw, in which the movable jaw is supported on the casing by a pair of eccentric shafts, wherein the crusher bucket comprises an adjustment device which is capable of varying a distance between the fixed jaw and the movable jaw at least in a region of a discharge of the material, wherein the adjustment device comprises at least one spacer arranged between an abutment portion and at least one movable support, on which at least one of the eccentric shafts is supported in a rotatable manner, the movable support being fixed in a sliding manner to side walls of the casing, the eccentric shafts comprising a central portion and end portions which are eccentric with respect to the central portion, the movable jaw being supported on the central portion and the end portions being supported on the movable support.

2. The bucket according to claim 1, comprising two movable supports, wherein both the eccentric shafts are supported in an adjustable manner to the casing by a respective movable support.

3. The bucket according to claim 1, wherein the abutment portion extends between side walls.

4. The bucket according to claim 1, wherein the at least one spacer abuts the movable support and the abutment portion in such a manner that the distance between the jaws is adjusted in accordance with the height or the number of the space.

5. The bucket according to claim 1, wherein the movable support is slidable on guides.

6. The bucket according to claim 5, wherein the guides are formed on the movable support.

7. The bucket according to claim 1, wherein the movable support comprises a support plate.

8. The bucket according to claim 1, wherein there are defined in the casing an inlet for charging material to be crushed and an opposite discharge for discharging the processed material, the movable jaw is supported by a first eccentric shaft of the pair of the eccentric shaft adjacent to the inlet and by a second eccentric shaft of the pair of the eccentric shaft adjacent to the discharge.

9. A crusher bucket comprising a casing in which there are mounted crushing elements comprising a fixed jaw and a movable jaw, in which the movable jaw is supported on the casing by a pair of eccentric shafts, wherein the crusher bucket comprises an adjustment device which is capable of varying a distance between the fixed jaw and the movable jaw at least in a region of a discharge of the material, wherein the adjustment device comprises a wedge-like member which is positionable between the eccentric shaft and the movable jaw.

10. A crusher bucket comprising a casing in which there are mounted crushing elements comprising a fixed jaw and a movable jaw, in which the movable jaw is supported on the casing by a pair of eccentric shafts, wherein the crusher bucket comprises an adjustment device which is capable of varying a distance between the fixed jaw and the movable jaw at least in a region of a discharge of the material, wherein the adjustment device is arranged in a region of a support portion of the movable jaw, the support portion comprising a first portion and a second portion each connected to one of the eccentric shafts, respectively, wherein a plate supporting the movable jaw is connected to the first portion, the first and second portions being movable relative to each other, the lower base of the second portion being movable away from a respective abutment surface with respect to the first portion so that one or more spacers can be arranged between the first portion and the second portion, thereby moving the rear portion of the movable jaw away with respect to the rear eccentric shaft, the adjustment device comprising an adjustment screw which is capable of adjusting the distance between said first portion and said second portion.

* * * * *